US010013914B2

(12) United States Patent
Park et al.

(10) Patent No.: US 10,013,914 B2
(45) Date of Patent: Jul. 3, 2018

(54) PIXEL AND ORGANIC LIGHT EMITTING DISPLAY DEVICE USING THE SAME

(71) Applicant: Samsung Display Co., Ltd., Yongin-si, Gyeonggi-do (KR)

(72) Inventors: Su Hyeong Park, Yongin-si (KR); Joon Chul Goh, Yongin-si (KR); Bong Hyun You, Yongin-si (KR); Jun Woo Hong, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 8 days.

(21) Appl. No.: 14/996,194

(22) Filed: Jan. 14, 2016

(65) Prior Publication Data

US 2016/0322446 A1 Nov. 3, 2016

(30) Foreign Application Priority Data

Apr. 30, 2015 (KR) ..... 10-2015-0061494

(51) Int. Cl.

| | |
|---|---|
| ***G09G 3/30*** | (2006.01) |
| ***G09G 3/3233*** | (2016.01) |
| ***G09G 3/3266*** | (2016.01) |
| ***G09G 3/3283*** | (2016.01) |

(52) U.S. Cl.

CPC ..... *G09G 3/3233* (2013.01); *G09G 3/3266* (2013.01); *G09G 3/3283* (2013.01); *G09G 2300/0426* (2013.01); *G09G 2300/0819* (2013.01); *G09G 2300/0842* (2013.01); *G09G 2300/0861* (2013.01); *G09G 2310/0251* (2013.01); *G09G 2310/0262* (2013.01); *G09G 2320/0233* (2013.01); *G09G 2320/043* (2013.01)

(58) Field of Classification Search

CPC ... G09G 3/30; G09G 5/00; G09G 3/36; G06F 3/038

See application file for complete search history.

(56) References Cited

U.S. PATENT DOCUMENTS

| | | | | |
|---|---|---|---|---|
| 8,902,207 | B2 | 12/2014 | Ryu et al. | |
| 2008/0246713 | A1* | 10/2008 | Lee | G09G 3/3648 345/89 |
| 2011/0199404 | A1 | 8/2011 | Umezaki et al. | |
| 2012/0001896 | A1* | 1/2012 | Han | G09G 3/3233 345/214 |

(Continued)

FOREIGN PATENT DOCUMENTS

| | | | |
|---|---|---|---|
| KR | 10-1082167 | B1 | 11/2011 |
| KR | 10-2014-0071600 | A | 6/2014 |

(Continued)

*Primary Examiner* — Pegeman Karimi

(74) *Attorney, Agent, or Firm* — Lewis Roca Rothgerber Christie LLP

(57) ABSTRACT

There is provided a pixel including an organic light emitting diode (OLED), a first transistor having a first electrode connected to a first power source and configured to control an amount of current supplied from the first power source to the OLED in response to a data signal, a second transistor and a third transistor connected between a second electrode and a gate electrode of the first transistor, and a fourth transistor connected between an initializing power source and a first node that is a common node of the second transistor and the third transistor.

16 Claims, 11 Drawing Sheets

(56) References Cited

U.S. PATENT DOCUMENTS

| | | | | |
|---|---|---|---|---|
| 2013/0002632 | A1* | 1/2013 | Choi | G09G 3/325 345/211 |
| 2014/0152719 | A1* | 6/2014 | Jung | G09G 3/3233 345/691 |
| 2014/0160182 | A1 | 6/2014 | Hong et al. | |
| 2014/0210867 | A1* | 7/2014 | Kwon | G09G 3/3258 345/690 |
| 2014/0327664 | A1 | 11/2014 | Kanda et al. | |
| 2016/0035306 | A1 | 2/2016 | Park et al. | |

FOREIGN PATENT DOCUMENTS

| | | | |
|---|---|---|---|
| KR | 10-2014-0076252 | A | 6/2014 |
| KR | 10-2014-0130630 | A | 11/2014 |
| KR | 10-2016-0017250 | | 2/2016 |

* cited by examiner

PIXEL AND ORGANIC LIGHT EMITTING DISPLAY DEVICE USING THE SAME

CROSS-REFERENCE TO RELATED APPLICATION

This application claims priority to and the benefit of Korean Patent Application No. 10-2015-0061494, filed on Apr. 30, 2015, in the Korean Intellectual Property Office, the entire content of which is incorporated herein by reference in its entirety.

BACKGROUND

1. Field

Aspects of embodiments of the present invention relate to a pixel and an organic light emitting display device using the same.

2. Description of the Related Art

With the development of information technology (IT), importance of a display device that is a connection medium between a user and information is spotlighted. Therefore, use of flat panel displays (FPDs), such as liquid crystal display devices (LCDs), organic light emitting display devices, and plasma display panels (PDPs) is increasing.

In the FPD, the organic light emitting display device displays an image by using organic light emitting diodes (OLEDs) that generate light components by re-combination of electrons and holes. The organic light emitting display device has a high response speed and has low power consumption.

The organic light emitting display device includes a plurality of data lines and scan lines and a plurality of pixels arranged in a matrix at crossing regions of power source lines. Each of the pixels is commonly formed of an OLED, two or more transistors including a driving transistor, and one or more capacitors.

The organic light emitting display device has small power consumption. However, an amount of current that flows to the OLED changes in accordance with a deviation in threshold voltage of the driving transistor included in each of the pixels so that non-uniformity in display is caused. Therefore, a method of compensating for the threshold voltage of the driving transistor while diode connecting the driving transistor is suggested.

However, when the driving transistor is diode connected, current paths are formed between a gate electrode of the driving transistor and an initializing power source and a common node between a first power source ELVDD and the OLED and the gate electrode of the driving transistor.

Here, flow of current to the current path between the common node and the gate electrode of the driving transistor is controlled in response to a voltage of a data signal. That is, when a low grayscale data signal having a high voltage is supplied, current flows from the gate electrode of the driving transistor to the common node and, when a high grayscale data signal having a low voltage is supplied, current flows from the common node to the gate electrode of the driving transistor.

Therefore, when the low grayscale data signal is supplied to a pixel, brightness increases with the lapse of time and, when the high grayscale data signal is supplied to a pixel, brightness is reduced with the lapse of time. In particular, when the pixel is driven at a low frequency (e.g., 20 Hz) in order to reduce power consumption, non-uniformity in brightness, which is caused by increase and reduction in the brightness, becomes severe.

SUMMARY

Aspects of embodiments of the present invention are directed to a pixel capable of securing uniformity in brightness and an organic light emitting display device using the same.

According to some embodiments of the present invention, there is provided a pixel including: an organic light emitting diode (OLED); a first transistor having a first electrode connected to a first power source and configured to control an amount of current supplied from the first power source to the OLED in response to a data signal; a second transistor and a third transistor connected between a second electrode and a gate electrode of the first transistor; and a fourth transistor connected between an initializing power source and a first node that is a common node of the second transistor and the third transistor.

In an embodiment, the second transistor and the third transistor are concurrently turned on and off.

In an embodiment, the second transistor has a turn-on period overlapping that of the third transistor and is configured to maintain a turn-on state for a longer time than the third transistor.

In an embodiment, the pixel further includes a fifth transistor connected between a data line and the first electrode of the first transistor and having a turn-on period at least partially overlapping those of the second transistor and the third transistor.

In an embodiment, the pixel further includes a storage capacitor connected between the gate electrode of the first transistor and the first power source, and configured to store the data signal.

In an embodiment, the pixel further includes: a sixth transistor connected between the first power source and the first electrode of the first transistor and having a first turn-on period not overlapping that of the third transistor; and a seventh transistor connected between the second electrode of the first transistor and the OLED and having a second turn-on period partially overlapping that of the third transistor.

In an embodiment, the fourth transistor and the seventh transistor are concurrently turned on and off.

According to some embodiments of the present invention, there is provided an organic light emitting display device including: a scan driver configured to supply scan signals to scan lines and emission control signals to emission control lines; a data driver configured to supply data signals to data lines; and a plurality of pixels in regions defined by the scan lines and the data lines, wherein each of the pixels positioned in an ith (i is a natural number) horizontal line includes: an organic light emitting diode (OLED); a first transistor having a first electrode connected to a first power source and configured to control an amount of current supplied from the first power source to the OLED in response to a data signal of the data signals; a second transistor and a third transistor connected between a second electrode and a first gate electrode of the first transistor; and a fourth transistor connected between an initializing power source and a first node that is a common node of the second transistor and the third transistor.

In an embodiment, the scan driver is configured to sequentially supply the scan signals to the scan lines and to sequentially supply the emission control signals to the emission control lines, each of the scan signals having a gate-on voltage, each of the emission control signals having a gate-off voltage.

In an embodiment, the scan driver is configured to supply, to an ith scan line of the scan signals, an ith scan signal of the scan signals partially overlapping an (i−1)th scan signal of the scan signals supplied to an (i−1)th scan line of the scan lines.

In an embodiment, the scan driver is configured to supply, to an ith emission control line of the emission control lines, an emission control signal of the emission control signals partially overlapping an (i−1)th scan signal of the scan signals supplied to an (i−1)th scan line and completely overlapping an ith scan signal of the scan signals supplied to an ith scan line of the scan lines.

In an embodiment, gate electrodes of the second transistor and the third transistor are connected to an (i−1)th scan line of the scan lines.

In an embodiment, the organic light emitting display device further includes a control line driver configured to sequentially supply control signals set to have a gate-on voltage to control lines connected to the pixels, the control lines being parallel to the scan lines.

In an embodiment, the control line driver is configured to supply a control signal of the control signals to an ith control line of the control lines overlapping, and having a larger width than that of, an (i−1)th scan signal of the scan signals.

In an embodiment, a second gate electrode of the second transistor is connected to the ith control line; and a third gate electrode of the third transistor is connected to the (i−1)th scan line.

In an embodiment, each of the pixels positioned in the ith horizontal line includes: a fifth transistor connected between a data line of the data lines and the first electrode of the first transistor and having a fifth gate electrode connected to an ith scan line of the scan lines; a sixth transistor connected between the first electrode of the first transistor and the first power source and having a sixth gate electrode connected to an (i−1)th emission control line of the emission control lines; a seventh transistor connected between the second electrode of the first transistor and the OLED and having a seventh gate electrode connected to an ith emission control line of the emission control lines; and a storage capacitor connected between the first gate electrode of the first transistor and the first power source.

In an embodiment, a fourth gate electrode of the fourth transistor is connected to the ith emission control line.

In the pixel, according to the embodiment of the present invention, and the organic light emitting display device using the same, the voltage of the common node between the first power source and the OLED does not affect the gate electrode of the driving transistor. Therefore, the pixel, according to the embodiment of the present invention, and the organic light emitting display device using the same may implement an image with uniform brightness.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will full convey the scope of the example embodiments to those skilled in the art.

In the drawings, dimensions may be exaggerated for clarity of illustration. Like reference numerals refer to like elements throughout.

DETAILED DESCRIPTION

Figure 1:
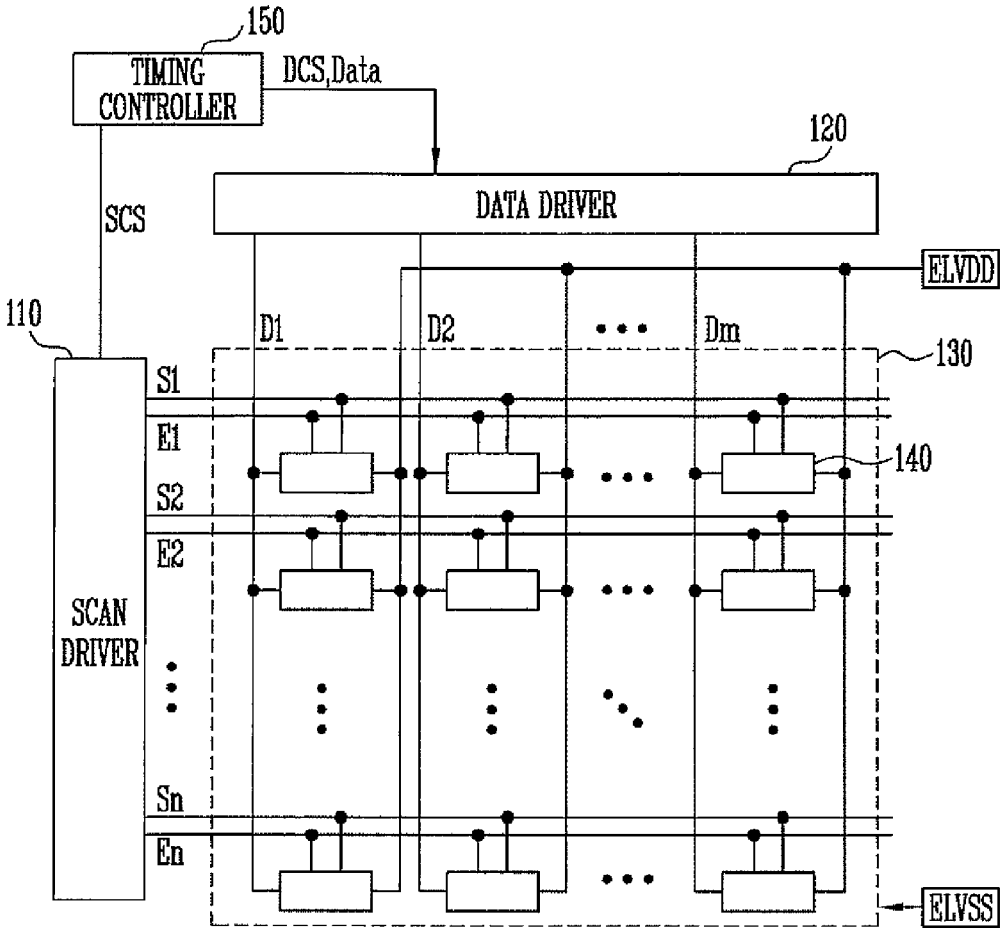
FIG. 1 is a view illustrating an organic light emitting display device according to an embodiment of the present invention.

Embodiments of the present invention will now be described more fully hereinafter with reference to the accompanying drawings; however, embodiments of the present invention should not be construed as limited to the illustrated embodiments set forth herein. Rather, these embodiments are provided so that this disclosure will be thorough and complete, and will full convey the scope of the example embodiments to those skilled in the art.

In the drawings, dimensions may be exaggerated for clarity of illustration. Like reference numerals refer to like elements throughout.

FIG. 1 is a view illustrating an organic light emitting display device according to an embodiment.

Referring to FIG. 1, the organic light emitting display device according to the embodiment of the present invention includes a pixel unit 130 including pixels 140 positioned at crossing regions of scan lines S1 to Sn and data lines D1 to Dm, a scan driver 110 for driving the scan lines S1 to Sn and emission control lines E1 to En, a data driver 120 for driving the data lines D1 to Dm, and a timing controller 150 for controlling the scan driver 110 and the data driver 120.

The timing controller 150 generates a data driving control signal DCS and a scan driving control signal SCS in response to synchronizing signals supplied from the outside. The data driving control signal DCS generated by the timing controller 150 is supplied to the data driver 120, and the scan driving control signal SCS generated by the timing controller 150 is supplied to the scan driver 110. The timing controller 150 re-arranges data Data supplied from the outside and supplies the re-arranged data Data to the data driver 120.

The scan driver 110 receives the scan driving control signal SCS from the timing controller 150. The scan driver 110 that receives the scan driving control signal SCS generates scan signals and supplies the generated scan signals to the scan lines S1 to Sn. For example, the scan driver 110 may sequentially supply the scan signals to the scan lines S1 to Sn. Here, a scan signal supplied to an ith (where i is a natural number) scan line Si may overlap a scan signal supplied to an (i−1)th scan line Si−1 in a preset or predetermined period. For example, the scan signals are supplied by the scan driver 110 in two horizontal periods 2H and the scan signal supplied to the ith scan line Si may overlap the scan signal supplied to the (i−1)th scan line Si−1 in one horizontal period 1H.

In addition, the scan driver 110 generates emission control signals in response to the scan driving control signal SCS and supplies the generated emission control signals to the emission control lines E1 to En. For example, the scan driver 110 may sequentially supply the emission control signals to the emission control lines E1 to En. Here, the emission control signals supplied by the scan driver 110 may be set to have larger widths than the scan signals. For example, an emission control signal supplied to an ith emission control line Ei overlaps the scan signal supplied to the (i−1)th scan line Si−1 in a partial period and may completely overlap the scan signal supplied to the ith scan line Si.

In addition, the scan signals supplied by the scan driver 110 are set to have a voltage (a gate-on voltage) by which transistors included in the pixels 140 may be turned on and the emission control signals supplied by the scan driver 110 are set to have a voltage (a gate-off voltage) by which the transistors included in the pixels 140 may be turned off.

The data driver 120 receives the data driving control signal DCS and the data Data from the timing controller 150. The data driver 120 converts the data Data into an analog data signal by using the data driving control signal DCS and supplies the data signals to the data lines D1 to Dm in synchronization with the scan signals.

The pixel unit 130 receives the first power source ELVDD and a second power source ELVSS from the outside and supplies the received first and second power sources ELVDD and ELVSS to the pixels 140. The pixels 140 that receive the first power source ELVDD and the second power source ELVSS respectively generate light components with preset or predetermined brightness components while controlling amounts of currents that flow from the first power source ELVDD to the second power source ELVSS via OLEDs in response to the data signals.

In FIG. 1, the n scan lines S1 to Sn and emission control lines E1 to En are illustrated. However, the present invention is not limited thereto. For example, at least one dummy scan line and emission control line may be additionally included in response to a structure of the pixel 140. The pixels 140 may be additionally connected to a scan line and an emission control line positioned in a previous horizontal line in response to a circuit structure.

Also, in FIG. 1, the scan driver 110 is illustrated as being connected to the scan lines S1 to Sn and the emission control lines E1 to En. However, the present invention is not limited thereto. For example, the emission control lines E1 to En are connected to an additional driver and may receive the emission control signals.

Figure 2:
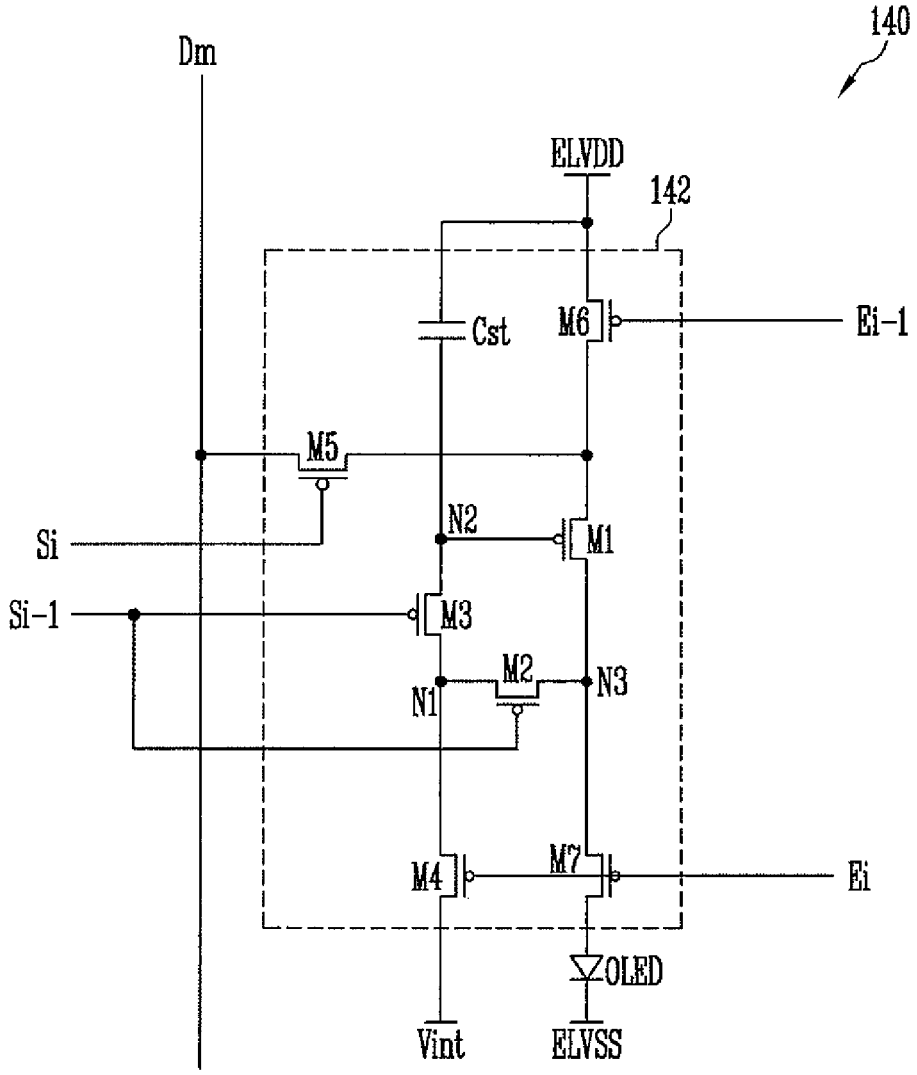
FIG. 2 is a circuit diagram illustrating an embodiment of the pixel of FIG. 1.

FIG. 2 is a circuit diagram illustrating an embodiment of the pixel of FIG. 1. In FIG. 2, for convenience sake, the pixel connected to the mth data line Dm and the ith scan line Si is illustrated.

Referring to FIG. 2, the pixel 140 according to the embodiment of the present invention includes an OLED and a pixel circuit 142 connected to the data line Dm, the scan lines Si−1 and Si, and the emission control lines Ei−1 and Ei to control an amount of current supplied to the OLED.

An anode electrode of the OLED is connected to the pixel circuit 142 and a cathode electrode thereof is connected to the second power source ELVSS. The OLED generates light with preset or predetermined brightness in response to the amount of current supplied by the pixel circuit 142. For this purpose, the second power source ELVSS is set to have a lower voltage than that of the first power source ELVDD.

The pixel circuit 142 controls an amount of current that flows from the first power source ELVDD to the second power source ELVSS via the OLED in response to a data signal. For this purpose, the pixel circuit 142 includes first to seventh transistors M1 to M7.

A first electrode of the first transistor M1 is connected to the first power source ELVDD via the sixth transistor M6, a second electrode thereof (connected to a third node N3) is connected to the anode electrode of the OLED via the seventh transistor M7, and a gate electrode thereof is connected to a second node N2. The first transistor M1 controls the amount of current supplied from the first power source ELVDD to the OLED in response to a voltage of the second node N2.

The second transistor M2 and the third transistor M3 are serially connected between a third node N3 and the second node N2. Gate electrodes of the second transistor M2 and the third transistor M3 are connected to the (i−1)th scan line Si−1. The second transistor M2 and the third transistor M3 are turned on, when the scan signal is supplied to the (i−1)th scan line Si−1, and diode connect the first transistor Mi.

The fourth transistor M4 is connected between a first node N1 that is a common node between the second transistor M2 and the third transistor M3 and an initializing power source Vint. A gate electrode of the fourth transistor M4 is connected to the ith emission control line Ei. The fourth transistor M4 is turned off when the emission control signal is supplied to the ith emission control line Ei, and is turned on otherwise. In addition, the initializing power source Vint for initializing the second node N2 is set to have a lower voltage than that of the data signal.

The fifth transistor M5 is connected between the data line Dm and the first electrode of the first transistor M1. A gate electrode of the fifth transistor M5 is connected to the ith scan line Si. The fifth transistor M5 is turned on when the scan signal is supplied to the ith scan line Si and electrically connects the data line Dm and the first electrode of the first transistor M1.

The sixth transistor M6 is connected between the first power source ELVDD and the first electrode of the first transistor M1. A gate electrode of the sixth transistor M6 is connected to the (i−1)th emission control line Ei−1. The sixth transistor M6 is turned off when the emission control signal is supplied to the (i−1)th emission control line Ei−1 and is turned on otherwise.

The seventh transistor M7 is connected between the third node N3 and the anode electrode of the OLED. A gate electrode of the seventh transistor M7 is connected to the ith emission control line Ei. The seventh transistor M7 is turned off when the emission control signal is supplied to the ith emission control line Ei, and is turned on otherwise.

A storage capacitor Cst is connected between the first power source ELVDD and the second node N2. The storage capacitor Cst stores a voltage corresponding to the data signal.

Figure 3:
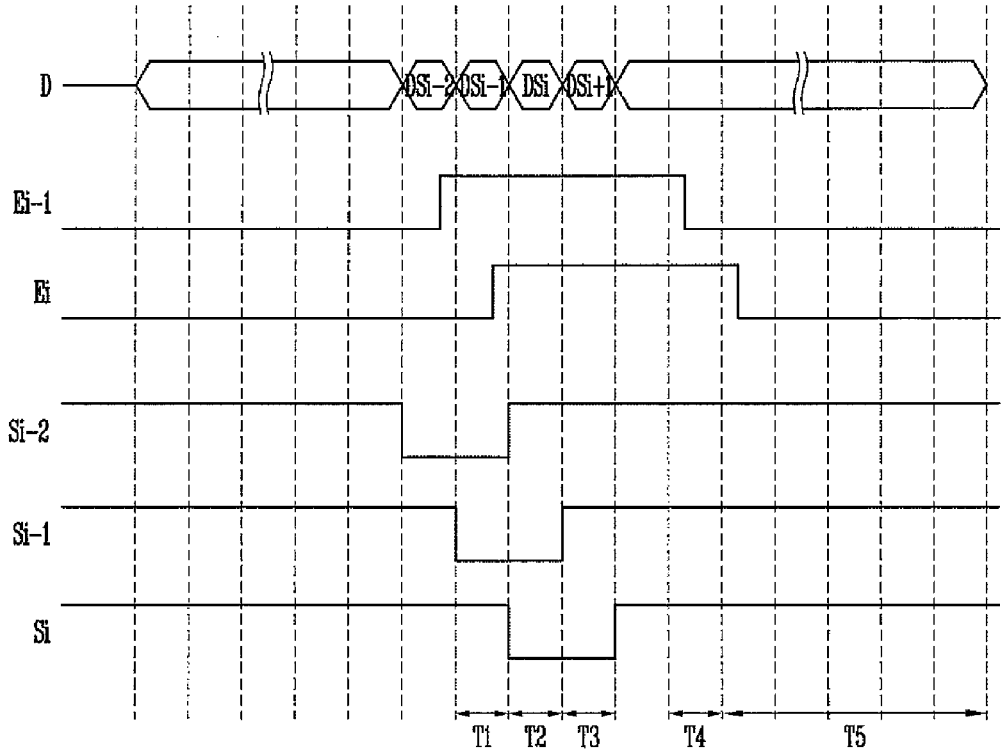
FIG. 3 is a view illustrating an embodiment of driving waveforms supplied to the pixel of FIG. 2.

FIG. 3 is a view illustrating an embodiment of driving waveforms supplied to the pixel of FIG. 2. FIGS. 4A to 4E are views illustrating operation processes of a pixel corresponding to the driving waveforms of FIG. 3.

Referring to FIGS. 3, 4A to 4E, first, in a first period T1, the emission control signal is supplied to the (i−1)th emission control line Ei−1 and the scan signal is supplied to the (i−1)th scan line Si−1. When the emission control signal is supplied to the (i−1)th emission control line Ei−1, the sixth transistor M6 is turned off. When the scan signal is supplied to the (i−1)th scan line Si−1, the second transistor M2 and the third transistor M3 are turned on.

Figure 4A:
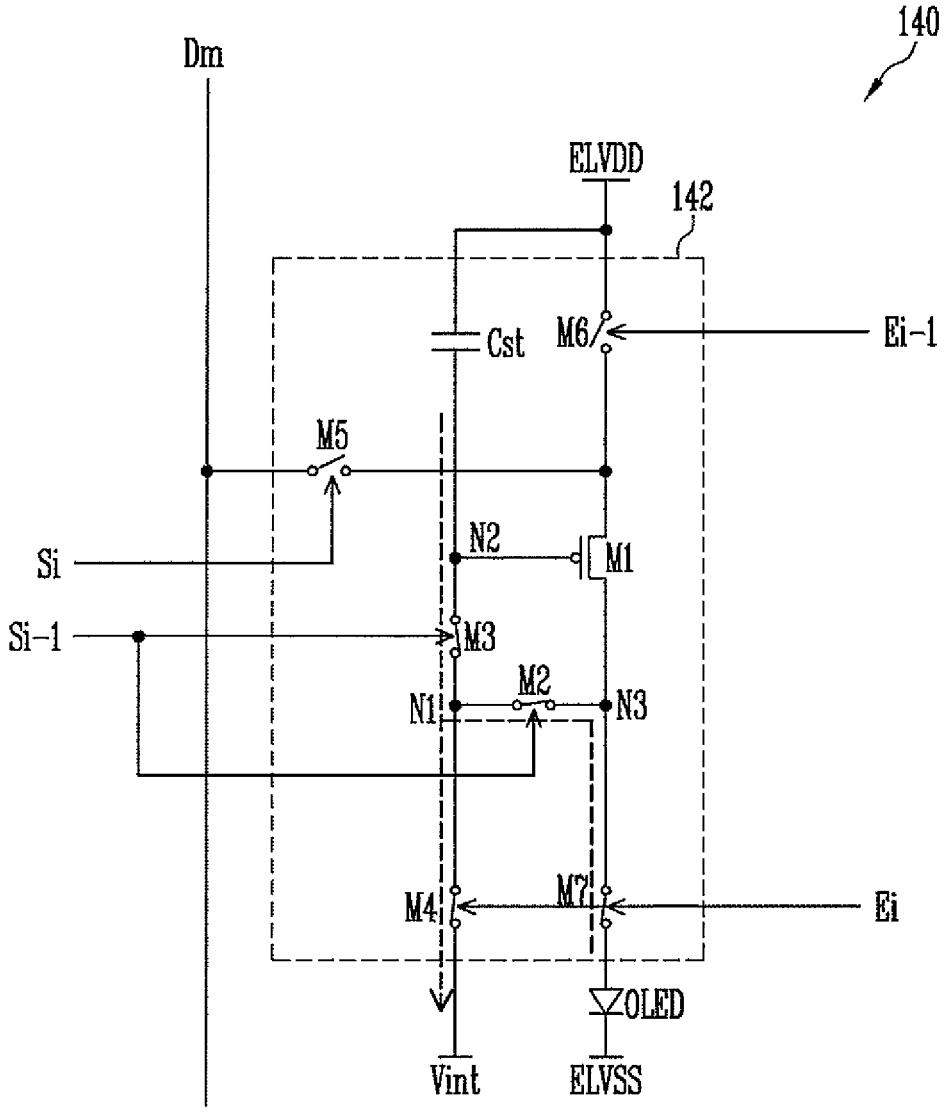
FIGS. 4A to 4E are views illustrating operation processes of a pixel corresponding to the driving waveforms of FIG. 3.

When the second transistor M2 is turned on, the anode electrode of the OLED and the first node N1 are electrically connected. When the third transistor M3 is turned on, the second node N2 and the first node N1 are electrically connected. Here, because the fourth transistor M4 is set to be in an on state in the first period T1, the first node N1 is electrically connected to the initializing power source Vint. Therefore, in the first period T1, as illustrated in FIG. 4A, the second node N2 and the anode electrode of the OLED are initialized by a voltage of the initializing power source Vint.

In a second period T2, the emission control signal is supplied to the ith emission control line Ei and the scan signal is supplied to the ith scan line Si. When the emission control signal is supplied to the ith emission control line Ei, the fourth transistor M4 and the seventh transistor M7 are turned off. When the scan signal is supplied to the ith scan line Si, the fifth transistor M5 is turned on.

Figure 4B:
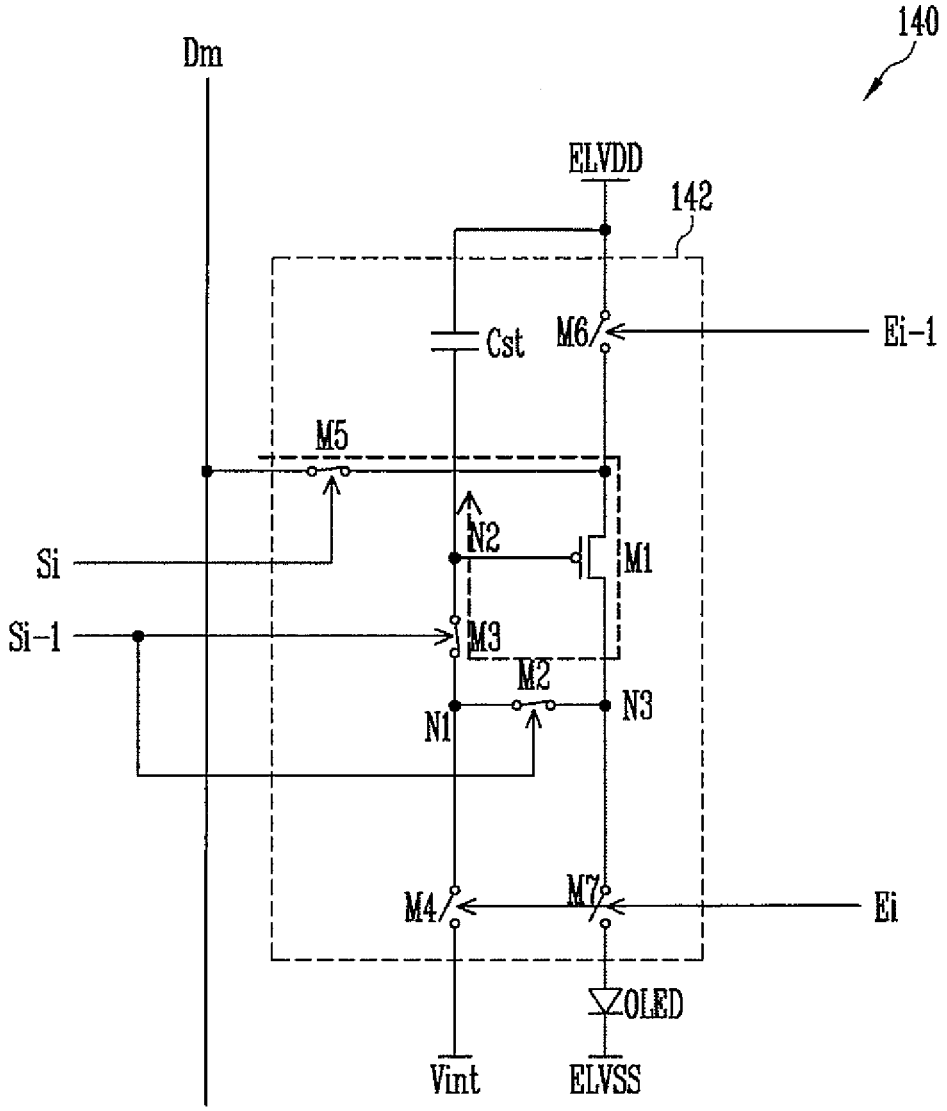

When the fifth transistor M5 is turned on, as illustrated in FIG. 4B, a data signal DSi from the data line Dm is supplied to the first electrode of the first transistor M1 via the fifth transistor M5.

At this time, because the second transistor M2 and the third transistor M3 are turned on, the first transistor M1 is diode connected. Because the second node N2 is set to have the voltage of the initializing power source Vint, the first transistor M1 is turned on. When the first transistor M1 is turned on, the data signal DSi supplied to the first electrode of the first transistor M1 is supplied to the second node N2. Because the first transistor M1 is diode connected, the voltage of the second node N2 increases to a voltage obtained by subtracting an absolute value of a threshold voltage of the first transistor M1 from a voltage of the data signal DSi (compensation of the threshold voltage). The storage capacitor Cst stores the voltage applied to the second node N2.

Figure 4C:
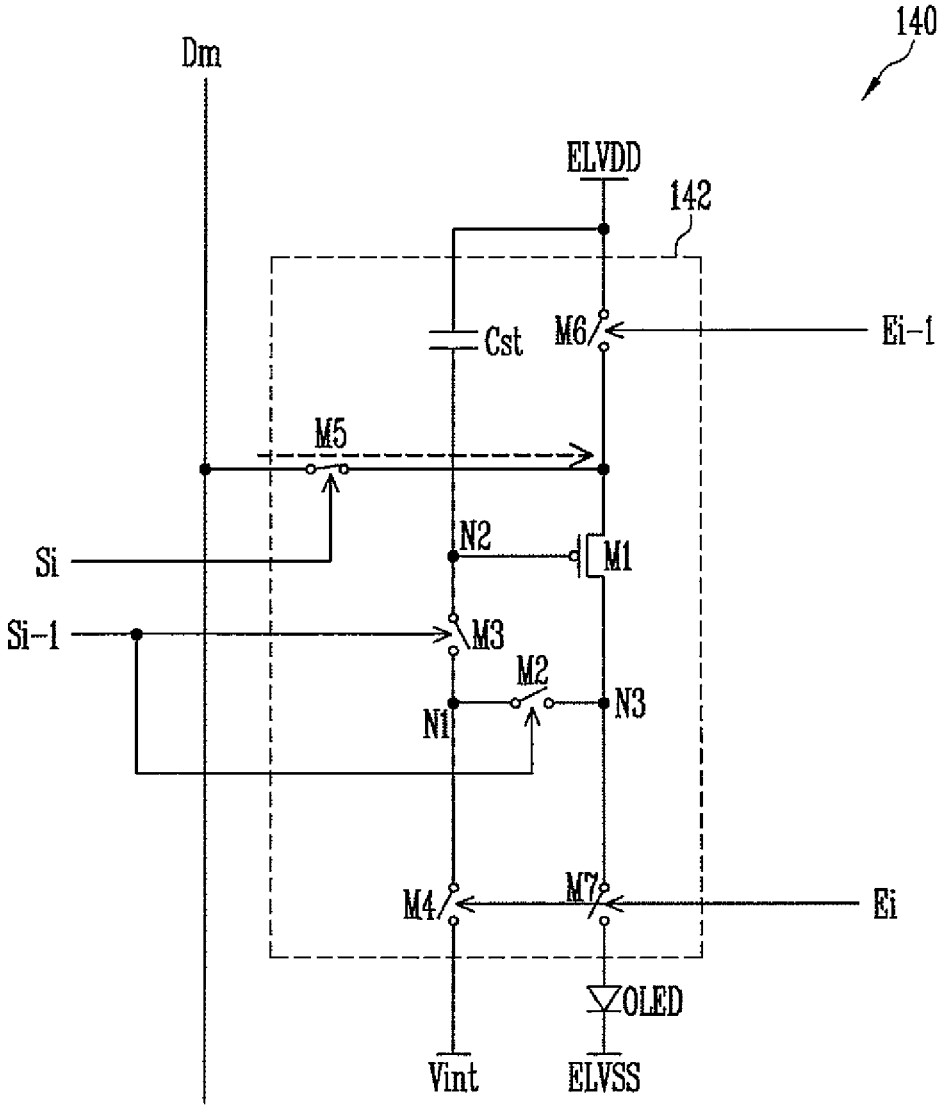

In a third period T3, supply of the scan signal to the (i−1)th scan line Si−1 is stopped. When supply of the scan signal to the (i−1)th scan line Si−1 is stopped, the second transistor M2 and the third transistor M3 are turned off. Then, as illustrated in FIG. 4C, a data signal DSi+1 supplied to the data line Dm in the third period T3 is not supplied to the second node N2. That is, the storage capacitor Cst stably maintains the voltage charged in the second period T2.

Figure 4D:
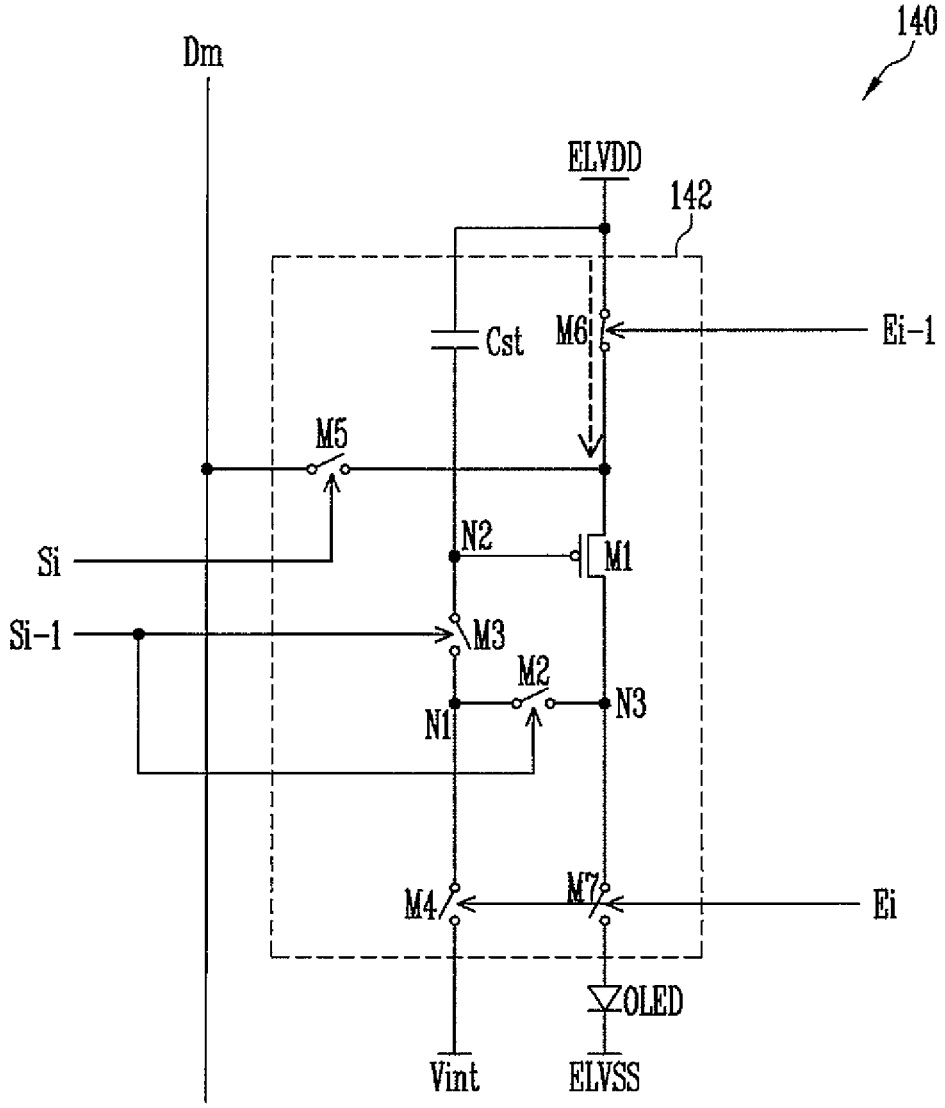

In a fourth period T4, supply of the emission control signal to the (i−1)th emission control line Ei−1 is stopped. When supply of the emission control signal to the (i−1)th emission control line Ei−1 is stopped, as illustrated in FIG. 4D, the sixth transistor M6 is turned on. When the sixth transistor M6 is turned on, a voltage of the first power source ELVDD is supplied to the first electrode of the first transistor M1.

Figure 4E:
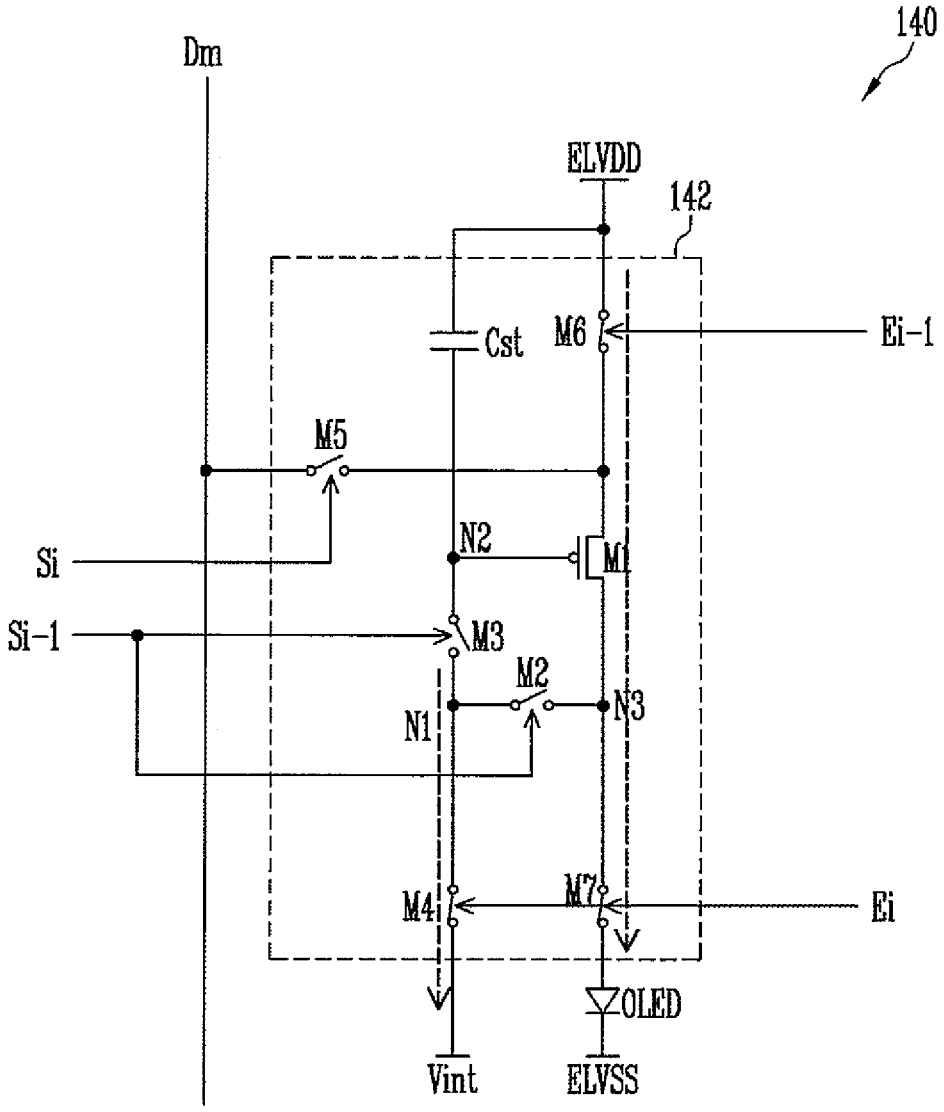

In a fifth period T5, supply of the emission control signal to the ith emission control line Ei is stopped. When supply of the emission control signal to the ith emission control line Ei is stopped, as illustrated in FIG. 4E, the fourth transistor M4 and the seventh transistor M7 are turned on.

When the fourth transistor M4 is turned on, the first node N1 and the initializing power source Vint are electrically connected. When the seventh transistor M7 is turned on, the first transistor M1 and the OLED are electrically connected. At this time, the first transistor M1 controls an amount of current that flows from the first power source ELVDD to the second power source ELVSS via the OLED in response to the voltage of the second node N2. Then, in the fifth period T5, the OLED generates light with a preset or predetermined brightness in response to an amount of current supplied thereto.

The pixel 140 according to the present invention has a current path that passes through the gate electrode of the first transistor M1, the second node N2, and the first node N1. Here, because the first node N1 maintains the voltage of the initializing power source Vint in the fifth period T5, amounts of currents that leak from the pixels 140 are set to be similar so that an image with uniform brightness may be displayed. That is, leakage current from a third node N3 is supplied to the first node N1 and is not supplied to the second node N2.

For example, according to the present invention, when the third transistor M3 is removed, a voltage of the third node N3 affects the voltage of the second node N2. That is, the leakage current is supplied from the second node N2 to the third node N3 in response to a low grayscale data signal and the leakage current is supplied from the third node N3 to the second node N2 in response to a high grayscale data signal. When the leakage current is generated between the second node N2 and the third node N3 in response to the data signal, it is difficult to secure uniformity in brightness.

In the present invention, when the third transistor M3 is included in the pixel 140, the voltage of the third node N3 does not affect the voltage of the second node N2. Therefore, according to the present invention, uniformity in brightness may be secured.

Figure 5:
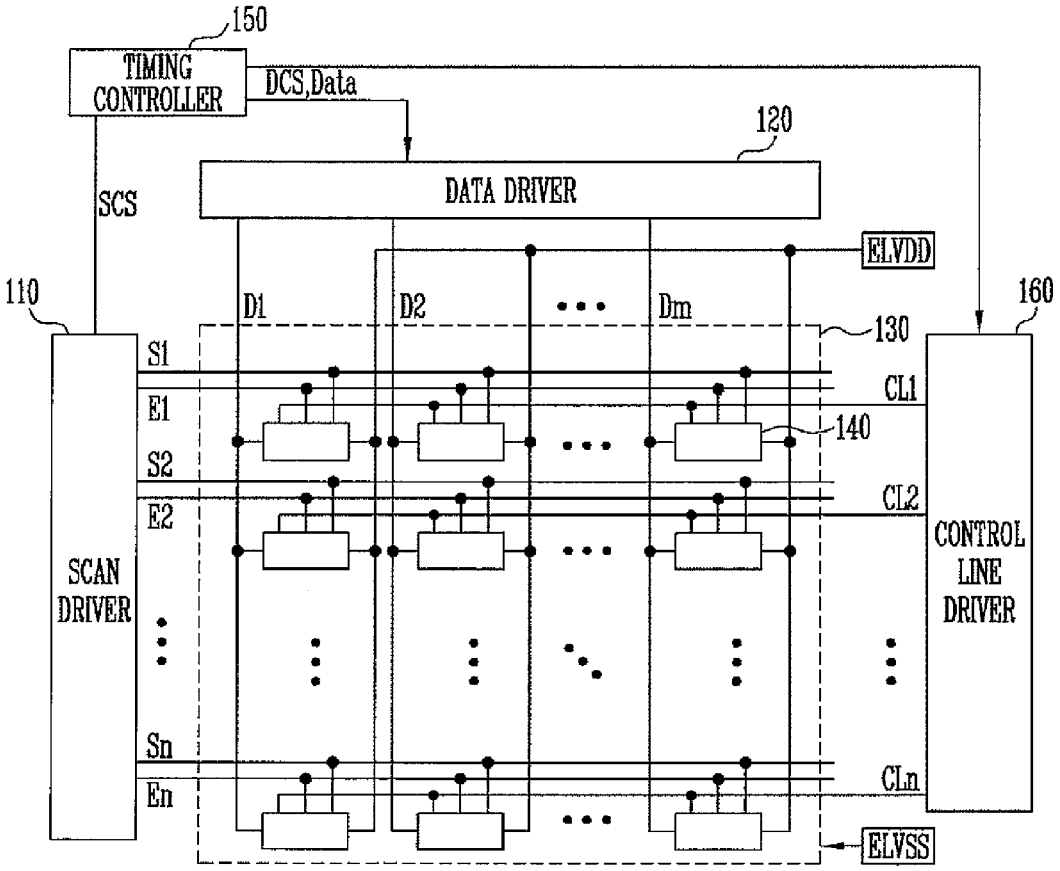
FIG. 5 is a view illustrating an organic light emitting display device according to another embodiment of the present invention.

FIG. 5 is a view illustrating an organic light emitting display device according to another embodiment. In FIG. 5, the same elements as those of FIG. 1 are denoted by the same reference numerals and detailed description thereof may not be repeated.

Referring to FIG. 5, the organic light emitting display device according to another embodiment of the present invention includes a control line driver 160 connected to control lines CL1 to CLn. The control lines CL1 to CLn are respectively formed in horizontal lines to run parallel with the scan lines S1 to Sn.

The control line driver 160 supplies control signals to the control lines CL1 to CLn in response to control of the timing controller 150. For example, the control line driver 160 may sequentially supply the control signals to the control lines CL1 to CLn. Here, the control signals are set to have a voltage (a gate-on voltage) by which the transistors included in the pixels 140 may be turned on. A control signal supplied to an ith control line CLi overlaps the scan signal supplied to the (i−1)th scan line Si−1 and has a larger width than the scan signal.

Figure 6:
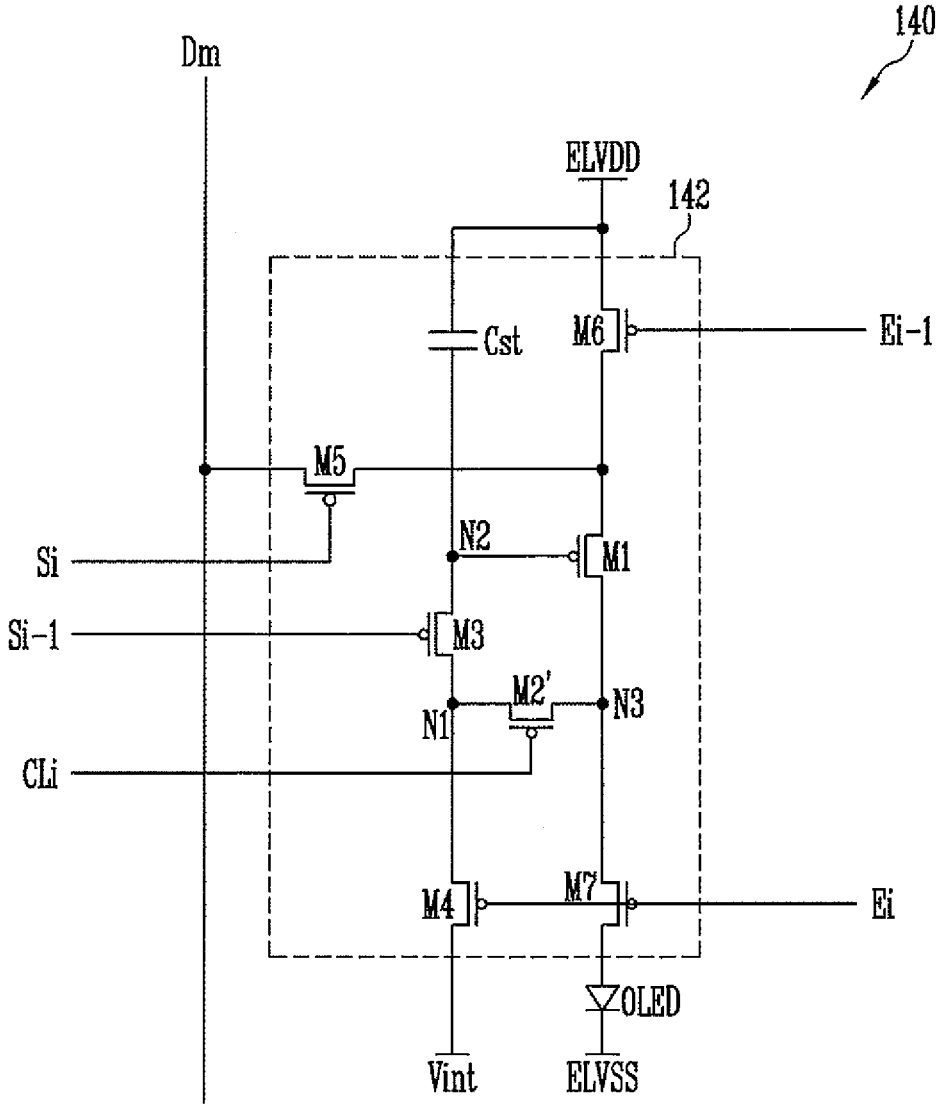
FIG. 6 is a circuit diagram illustrating an embodiment of the pixel of FIG. 5.

FIG. 6 is a circuit diagram illustrating an embodiment of the pixel of FIG. 5. In FIG. 6, the same elements as those of FIG. 2 are denoted by the same reference numerals and detailed description thereof may not be repeated.

Referring to FIG. 6, the pixel 140 according to another embodiment of the present invention includes the OLED and the pixel circuit 142 connected to the data line Dm, the control line CLi, the scan lines Si−1 and Si, and the emission control lines Ei−1 and Ei to control an amount of current supplied to the OLED.

The anode electrode of the OLED is connected to the pixel circuit 142, and the cathode electrode thereof is connected to the second power source ELVSS. The OLED generates light with preset or predetermined brightness in response to the amount of current supplied by the pixel circuit 142. For this purpose, the second power source ELVSS is set to have a lower voltage than that of the first power source ELVDD.

The pixel circuit 142 controls an amount of current that flows from the first power source ELVDD to the second power source ELVSS via the OLED in response to a data signal. For this purpose, the pixel circuit 142 includes a first transistor M1, a second transistor M2', a third transistor M3, a fourth transistor M4, a fifth transistor M5, a sixth transistor M6, and a seventh transistor M7.

The second transistor M2' is connected between the first node N1 and the third node N3. A gate electrode of the second transistor M2' is connected to the ith control line CLi. The second transistor M2' is turned on when the control signal is supplied to the ith control line CLi and electrically connects the first node N1 and the third node N3.

Figure 7:
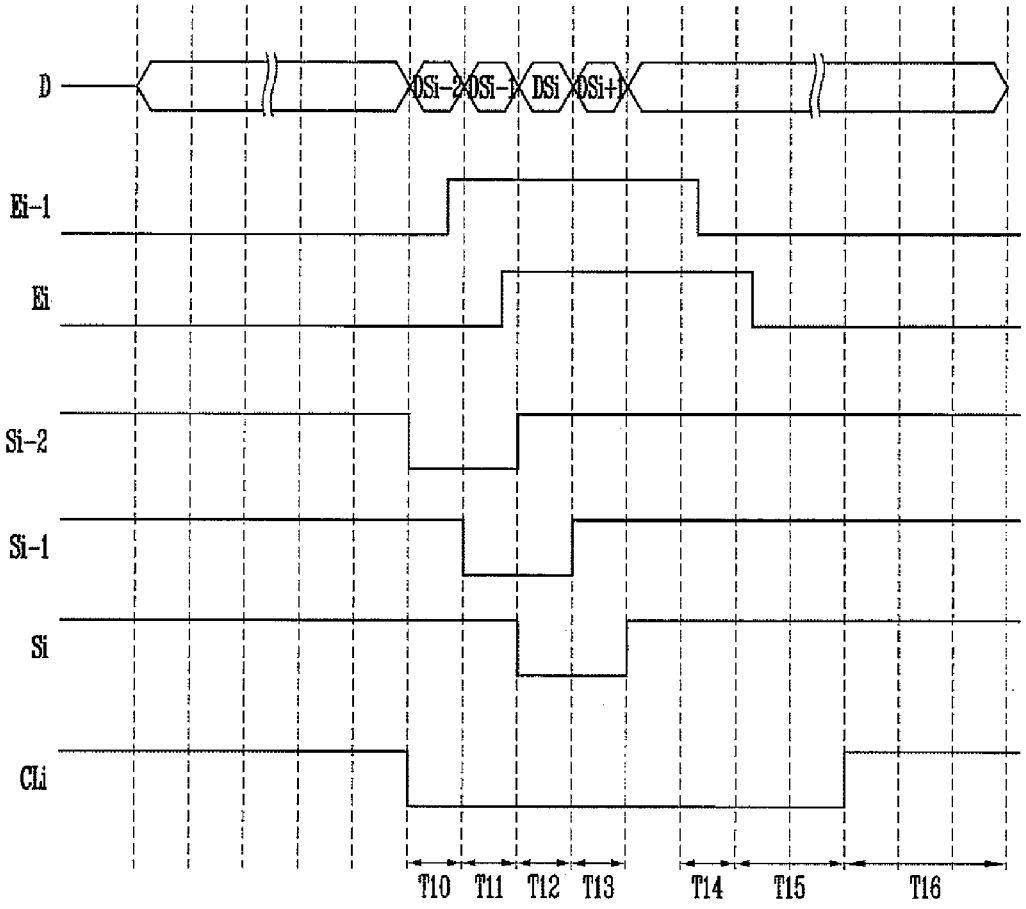
FIG. 7 is a view illustrating an embodiment of driving waveforms supplied to the pixel of FIG. 6.

FIG. 7 is a view illustrating an embodiment of driving waveforms supplied to the pixel of FIG. 6. When operation processes are described with reference to FIG. 7, portions different from the driving waveforms of FIG. 3 will be mainly described.

Referring to FIG. 7, first, in a tenth period T10, the control signal is supplied to the ith control line CLi. When the control signal is supplied to the ith control line CLi, the second transistor M2' is turned on. When the second transistor M2' is turned on, the voltage of the initializing power source Vint is supplied to the third node N3. When the voltage of the initializing power source Vint is supplied to the third node N3, the first transistor M1 is initialized to an on bias state.

For example, a characteristic curve (e.g., a threshold voltage) of the first transistor M1 changes in response to driving. When the characteristic curve of the first transistor M1 changes, brightness may be set to be non-uniform. Therefore, according to the present invention, in the tenth period T10, the second transistor M2' is turned on so that the first transistor M1 is set to be in the on bias state and the characteristic curve of the first transistor M1 may be initialized.

In an $11^{th}$ period T11, the emission control signal is supplied to the (i−1)th emission control line Ei−1 so that the sixth transistor M6 is turned off and the scan signal is supplied to the (i−1)th scan line Si−1 so that the third transistor M3 is turned on. When the third transistor M3 is turned on, the second node N2 and the first node N1 are electrically connected. Then, in the $11^{th}$ period T11, the second node N2 and the anode electrode of the OLED are initialized by the voltage of the initializing power source Vint.

In a $12^{th}$ period T12, the emission control signal is supplied to the ith emission control line Ei so that the fourth transistor M4 and the seventh transistor M7 are turned off and the scan signal is supplied to the ith scan line Si so that the fifth transistor M5 is turned on. When the fifth transistor M5 is turned on, the data signal DSi from the data line Dm is supplied to the second node N2 via the diode connected first transistor M1. At this time, the storage capacitor Cst stores the voltage applied to the second node N2.

In a $13^{th}$ period T13, supply of the scan signal to the (i−1)th scan line Si−1 is stopped so that the third transistor M3 is turned off. When the third transistor M3 is turned off, electrical connection between the second node N2 and the first node N1 is blocked. Therefore, the data signal DSi+1 supplied to the data line Dm in the $13^{th}$ period T13 is not supplied to the second node N2. That is, the storage capacitor Cst stably maintains the voltage charged in the $12^{th}$ period T12.

In a $14^{th}$ period T14, supply of the emission control signal to the (i−1)th emission control line Ei−1 is stopped so that the sixth transistor M6 is turned on. When the sixth transistor M6 is turned on, the voltage of the first power source ELVDD is supplied to the first electrode of the first transistor M1.

In a $15^{th}$ period T15, supply of the emission control signal to the ith emission control line Ei is stopped so that the fourth transistor M4 and the seventh transistor M7 are turned on. When the fourth transistor M4 is turned on, the first node N1 and the initializing power source Vint are electrically connected. When the seventh transistor M7 is turned on, the first transistor M1 and the OLED are electrically connected. At this time, because the second transistor M2' maintains a turn-on state, the voltage of the initializing power source Vint is supplied to the third node N3. Therefore, in the $15^{th}$ period 115, current supplied from the first transistor M1 is supplied to the initializing power source Vint. In the $15^{th}$ period T15, the first transistor M1 is initialized to the on bias state.

In a $16^{th}$ period T16, supply of the control signal to the ith control line CLi is stopped so that the second transistor M2' is turned off. When the second transistor M2' is turned off, the current supplied from the first transistor M1 is supplied to the OLED so that the OLED emits light.

As described above, according to the present invention, the first transistor M1 is set in the on bias state by using the control signal supplied to the ith control line CLi so that uniformity in brightness may be secured. In addition, according to the present invention, a period in which the control signal is supplied to the ith control line CLi is controlled so that an on bias period of the first transistor M1 may be controlled.

In addition, according to the present invention, for convenience sake, the transistors are illustrated as being p-channel metal-oxide-semiconductor field-effect transistors (MOSFET) (PMOS). However, the present invention is not limited thereto. That is, the transistors may be formed of n-channel MOSFETs (NMOS).

In addition, according to the present invention, the OLED generates red, green, or blue light in response to an amount of current supplied from the driving transistor. However, the present invention is not limited thereto. For example, the OLED may generate white light in response to the amount of current supplied from the driving transistor. In this case, a color image is implemented by using an additional color filter.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

In addition, it will also be understood that when a layer is referred to as being "between" two layers, it can be the only layer between the two layers, or one or more intervening layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent to" another element or layer, it can be directly on, connected to, coupled to, or adjacent to the other element or layer, or one or more intervening elements or layers may be present. When an element or layer is referred to as being "directly on," "directly connected to", "directly coupled to", or "immediately adjacent to" another element or layer, there are no intervening elements or layers present.

As used herein, the terms "use," "using," and "used" may be considered synonymous with the terms "utilize," "utilizing," and "utilized," respectively.

The organic light emitting display device and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the organic light emitting display device may be formed on one integrated circuit (IC) chip or on separate IC chips. Further, the various components of the organic light emitting display device may be implemented on a flexible printed circuit film, a tape carrier package (TOP), a printed circuit board (PCB), or formed on a same substrate. Further, the various components of the organic light emitting display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and equivalents thereof.

What is claimed is:

1. A pixel comprising:

an organic light emitting diode (OLED);

a first transistor having a first electrode connected to a first power source and configured to control an amount of current supplied from the first power source to the OLED in response to a data signal;

a second transistor and a third transistor connected between a second electrode and a gate electrode of the first transistor; and a fourth transistor connected between an initializing power source and a first node that is a common node of the second transistor and the third transistor, wherein a first electrode of the third transistor is directly connected to the fourth transistor and a second electrode of the third transistor is directly connected to the gate electrode of the first transistor, wherein the second transistor and the third transistor are concurrently turned on and off.

2. The pixel of claim 1, wherein the second transistor has a turn-on period overlapping that of the third transistor and is configured to maintain a turn-on state for a longer time than the third transistor.

3. The pixel of claim 1, further comprising a fifth transistor connected between a data line and the first electrode of the first transistor and having a turn-on period at least partially overlapping those of the second transistor and the third transistor.

4. The pixel of claim 1, further comprising a storage capacitor connected between the gate electrode of the first transistor and the first power source, and configured to store the data signal.

5. The pixel of claim 1, further comprising:

a sixth transistor connected between the first power source and the first electrode of the first transistor and having a first turn-on period not overlapping that of the third transistor; and a seventh transistor connected between the second electrode of the first transistor and the OLED and having a second turn-on period partially overlapping that of the third transistor.

6. The pixel of claim 5, wherein the fourth transistor and the seventh transistor are concurrently turned on and off.

7. An organic light emitting display device comprising:

a scan driver configured to supply scan signals to scan lines and emission control signals to emission control lines;

a data driver configured to supply data signals to data lines;

a plurality of pixels in regions defined by the scan lines and the data lines, wherein each of the pixels positioned in an ith (i is a natural number) horizontal line comprises:

an organic light emitting diode (OLED);

a first transistor having a first electrode connected to a first power source and configured to control an amount of current supplied from the first power source to the OLED in response to a data signal of the data signals;

a second transistor and a third transistor connected between a second electrode and a first gate electrode of the first transistor; and a fourth transistor connected between an initializing power source and a first node that is a common node of the second transistor and the third transistor, wherein a first electrode of the third transistor is directly connected to the fourth transistor and a second electrode of the third transistor is directly connected to the first gate electrode of the first transistor, wherein the second transistor and the third transistor are concurrently turned on and off.

8. The organic light emitting display device of claim 7, wherein the scan driver is configured to sequentially supply the scan signals to the scan lines and to sequentially supply the emission control signals to the emission control lines, each of the scan signals having a gate-on voltage, each of the emission control signals having a gate-off voltage.

9. The organic light emitting display device of claim 8, wherein the scan driver is configured to supply, to an ith scan line of the scan signals, an ith scan signal of the scan signals partially overlapping an (i−1)th scan signal of the scan signals supplied to an (i−1)th scan line of the scan lines.

10. The organic light emitting display device of claim 8, wherein the scan driver is configured to supply, to an ith emission control line of the emission control lines, an emission control signal of the emission control signals partially overlapping an (i−1)th scan signal of the scan signals supplied to an (i−1)th scan line and completely overlapping an ith scan signal of the scan signals supplied to an ith scan line of the scan lines.

11. The organic light emitting display device of claim 7, wherein gate electrodes of the second transistor and the third transistor are connected to an (i−1)th scan line of the scan lines.

12. The organic light emitting display device of claim 7, further comprising a control line driver configured to sequentially supply control signals set to have a gate-on voltage to control lines connected to the pixels, the control lines being parallel to the scan lines.

13. The organic light emitting display device of claim 12, wherein the control line driver is configured to supply a control signal of the control signals to an ith control line of the control lines overlapping, and having a larger width than that of, an (i−1)th scan signal of the scan signals.

14. The organic light emitting display device of claim 13, wherein a second gate electrode of the second transistor is connected to the ith control line; and wherein a third gate electrode of the third transistor is connected to the (i−1)th scan line.

15. The organic light emitting display device of claim 7, wherein each of the pixels positioned in an ith horizontal line comprises:

a fifth transistor connected between a data line of the data lines and the first electrode of the first transistor and having a fifth gate electrode connected to an ith scan line of the scan lines;

a sixth transistor connected between the first electrode of the first transistor and the first power source and having a sixth gate electrode connected to an (i−1)th emission control line of the emission control lines;

a seventh transistor connected between the second electrode of the first transistor and the OLED and having a seventh gate electrode connected to an ith emission control line of the emission control lines; and a storage capacitor connected between the first gate electrode of the first transistor and the first power source.

16. The organic light emitting display device of claim 15, wherein a fourth gate electrode of the fourth transistor is connected to the ith emission control line.

* * * * *